US009598933B2

(12) United States Patent
Inglis

(10) Patent No.: US 9,598,933 B2
(45) Date of Patent: Mar. 21, 2017

(54) REMOTE AND MANUAL ACTUATED A WELL TOOL

(71) Applicant: Halliburton Energy Services, Inc., Houston, TX (US)

(72) Inventor: Peter Derek Walter Inglis, Tayside (GB)

(73) Assignee: Halliburton Energy Services, Inc., Houston, TX (US)

( * ) Notice: Subject to any disclaimer, the term of this patent is extended or adjusted under 35 U.S.C. 154(b) by 36 days.

(21) Appl. No.: 14/370,393

(22) PCT Filed: Jun. 20, 2013

(86) PCT No.: PCT/US2013/046884

§ 371 (c)(1),
(2) Date: Jul. 2, 2014

(87) PCT Pub. No.: WO2014/204474

PCT Pub. Date: Dec. 24, 2014

(65) Prior Publication Data

US 2015/0226033 A1 Aug. 13, 2015

(51) Int. Cl.

| | |
|---|---|
| ***E21B 34/14*** | (2006.01) |
| ***E21B 34/10*** | (2006.01) |
| ***E21B 47/12*** | (2012.01) |

(52) U.S. Cl.

CPC ..... *E21B 34/14* (2013.01); *E21B 34/10* (2013.01); *E21B 34/102* (2013.01); *E21B 47/12* (2013.01)

(58) Field of Classification Search

CPC ..... E21B 34/14; E21B 34/10; E21B 34/102
See application file for complete search history.

(56) References Cited

U.S. PATENT DOCUMENTS

| | | | | |
|---|---|---|---|---|
| 6,085,845 | A | 7/2000 | Patel et al. | |
| 6,095,249 | A * | 8/2000 | McGarian | E21B 21/002 166/319 |
| 2009/0184278 | A1 | 7/2009 | Beall et al. | |
| 2009/0205833 | A1 | 8/2009 | Bunnell et al. | |
| 2009/0260835 | A1 | 10/2009 | Malone | |
| 2012/0312555 | A1 | 12/2012 | Caminari et al. | |

OTHER PUBLICATIONS

International Search Report and Written Opinion of the International Searching Authority issued in International Application No. PCT/US2013/046884 on Mar. 20, 2014; 15 pages.
PCT International Preliminary Report on Patentability, PCT/US2013/046884, Dec. 30, 2015, 12 pages.

* cited by examiner

*Primary Examiner* — David Bagnell
*Assistant Examiner* — Manuel C Portocarrero
(74) *Attorney, Agent, or Firm* — Scott Richardson; Parker Justiss, P.C.

(57) ABSTRACT

A well tool having an actuator sleeve in a housing. The actuator sleeve has an internal shifting tool engaging profile. The tool has an actuator in the housing that is responsive to a remote signal to change from an unactuated state to an actuated state and shift the actuator sleeve from a first position to a second position. A fluid chamber in the housing is defined between the actuator sleeve and the actuator. The fluid chamber contains a fluid to communicate movement of the actuator to the actuator sleeve.

20 Claims, 6 Drawing Sheets

REMOTE AND MANUAL ACTUATED A WELL TOOL

CLAIM OF PRIORITY

This application is a U.S. National Stage of PCT/US2013/046884 filed on Jun. 20, 2013.

BACKGROUND

There are numerous tools for use in a subterranean well that can be remotely actuated by a hydraulic, electric, and/or other type of signal generated remote from the tool. Some of these tools further include provisions for mechanical actuation, for example, by a shifting tool manipulated from the surface. The mechanical actuation provides an alternative or contingency mode of actuation apart from actuation in response to the remote signal. In actuating the tool manually, however, the shifting tool must overcome the remote actuator mechanism or the remote actuator mechanism must be uncoupled from the actuated element of the tool.

DESCRIPTION OF DRAWINGS

FIG. 2A depicts the example valve in an open position. FIG. 2B depicts the example valve in a closed position.

FIG. 3A depicts the valve in a run-in state, prior to be being remotely actuated and with its valve closure open. FIG. 3B depicts the valve prior to being remotely actuated and with its valve closure closed. FIG. 3C depicts the valve after being remotely actuated with its valve closure opened and the decoupling spring compressed. FIG. 3D depicts the valve after being remotely actuated with its valve closure opened and the decoupling spring expanded. FIG. 3E depicts the valve after being mechanically actuated with its valve closure closed.

Like reference symbols in the various drawings indicate like elements.

DETAILED DESCRIPTION

Figure 1:
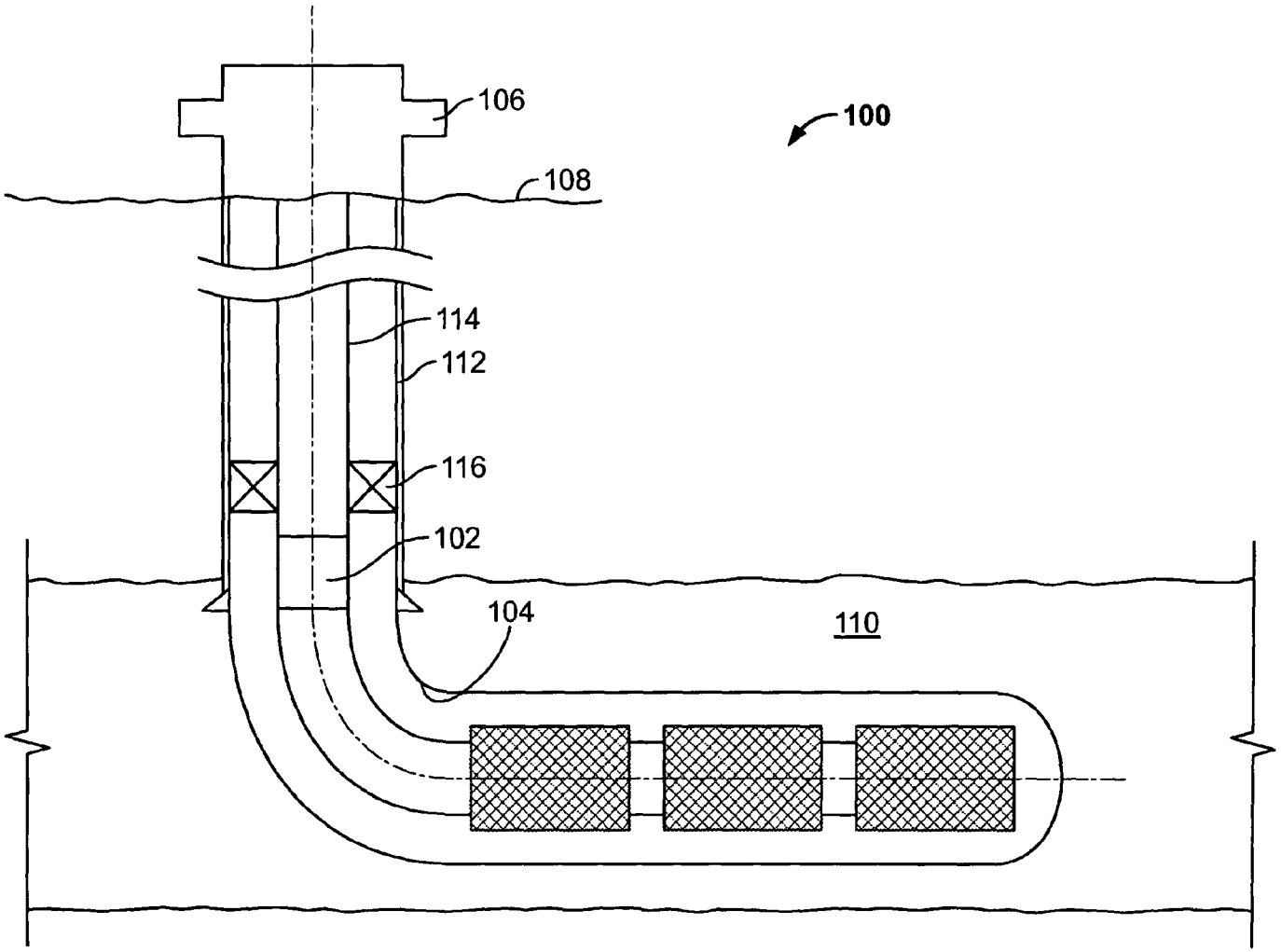
FIG. 1 is a side cross-sectional view of an example well system.

FIG. 1 is a side cross-sectional view of a well system 100 with an example valve 102 constructed in accordance with the concepts herein. The well system 100 is provided for convenience of reference only, and it should be appreciated that the concepts herein are applicable to a number of different configurations of well systems. As shown, the well system 100 includes a substantially cylindrical well bore 104 that extends from well head 106 at a terranean surface 108 through one or more subterranean zones of interest 110. In FIG. 1, the well bore 104 extends substantially vertically from the surface 108 and deviates to horizontal in the subterranean zone 110. However, in other instances, the well bore 104 can be of another configuration, for example, entirely substantially vertical or slanted, it can deviate in another manner than horizontal, it can be a multi-lateral, and/or it can be of another configuration. In certain instances, the well system 100 can be a sea-based well, in which case the surface 108 is at a sea-based platform, rig, and/or other.

The well bore 104 is lined with a casing 112 that extends from the well head 106 at the surface 108, downhole, toward the bottom of the well 104. The casing 112 provides radial support to the well bore 104 and seals against unwanted communication of fluids between the well bore 104 and surrounding formations. Here, the casing 112 ceases at the subterranean zone 110 and the remainder of the well bore 104 is an open hole, i.e., uncased. In other instances, the casing 112 can extend to the bottom of the well bore 104 or can be provided in another configuration.

A completion string 114 of tubing and other components is coupled to the well head 106 and extends, through the well bore 104, downhole, into the subterranean zone 110. The completion string 114 is the tubing that is used, once the well is brought onto production, to produce fluids from and/or inject fluids into the subterranean zone 110. Prior to bringing the well onto production, the completion string is used to perform the final steps in constructing the well. The completion string 114 is shown with a packer 116 above the subterranean zone 110 that seals the annulus between the completing string 114 and casing 112, and directs fluids to flow through the completion string 114 rather than the annulus.

The example valve 102 is provided in the completion string 114 below the packer 116, for example, in a lower completion, below the upper completion. The valve 102 when open, allows passage of fluid and communication of pressure through the completion string 114. When closed, the valve 102 seals against passage of fluid and communication of pressure between the lower portion of the completion string 114 below the valve 102 and the upper portion of the completion string 114. The valve 102 has provisions for both mechanical operation and operation in response to a remote originating signal. For mechanical operation, the valve 102 has an internal profile that can be engaged by a shifting tool to operate the valve. For remote operation, the valve 102 has an actuator assembly that responds to a signal (e.g., a hydraulic, electric, and/or other signal) to operate the valve. The signal can be generated remote from the valve 102, for example at the surface.

In the depicted example, the valve 102 is shown as a fluid isolation valve that is run into the well bore 104 open, mechanically closed with a shifting tool and then eventually re-opened in response to a remote signal. The valve 102, thus allows an operator to fluidically isolate the subterranean zone 110, for example, while an upper portion of the completion string 114 is being constructed, while subterranean zones above the valve 102 are being produced (e.g., in a multi-lateral well), and for other reasons. The concepts herein, however, are applicable to other configurations of valves and/or other equipment. In one example, the valve 102 could be configured as a safety valve. A safety valve is typically placed in the completion string 114 or riser (e.g., in a subsea well), and is biased closed and held open by a remote signal. When the remote signal is ceased, for example, due to failure of the well system above the valve 102, the valve 102 closes. Thereafter, the valve 102 is mechanically re-opened to recommence operation of the well.

Figure 2A:
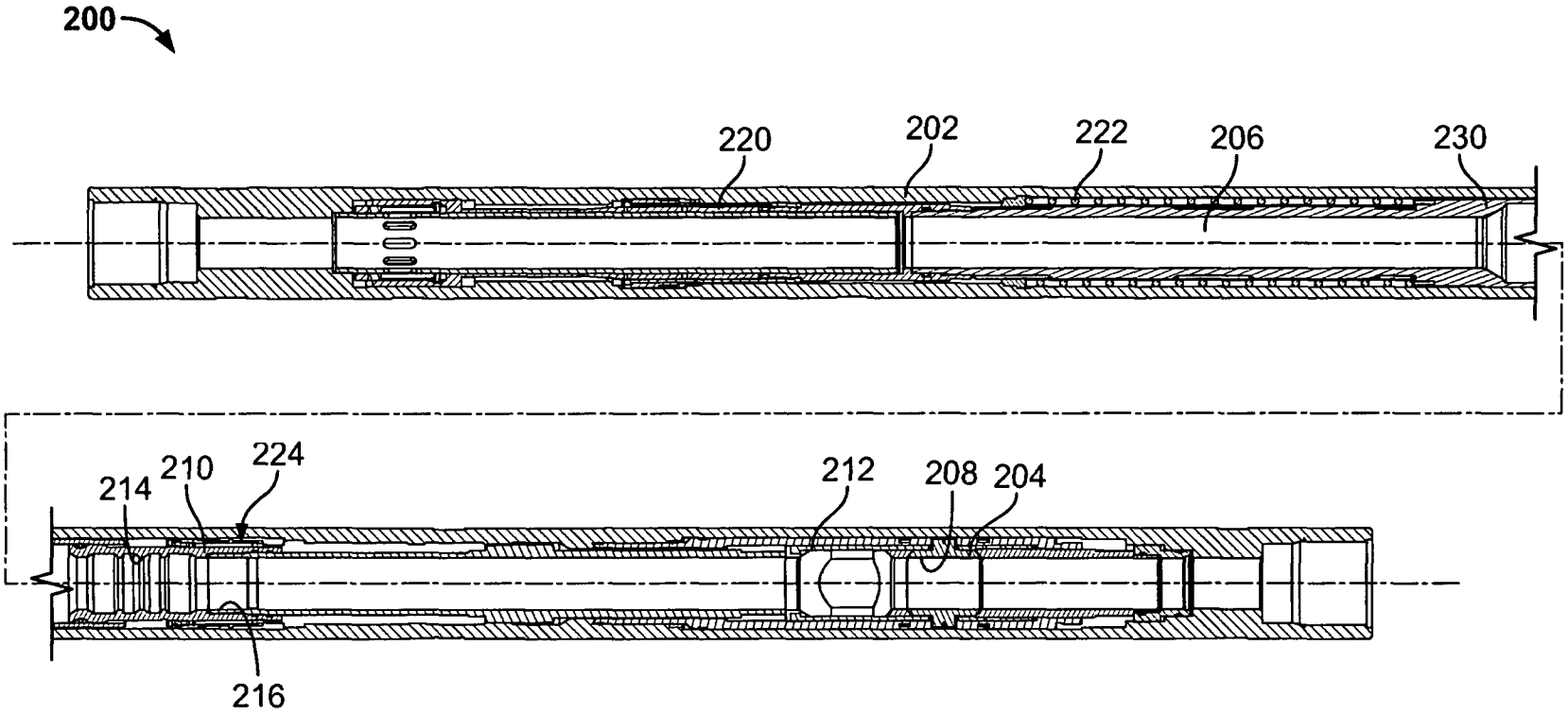
FIGS. 2A and 2B are detail side cross-sectional views of an example valve.
Figure 2B:
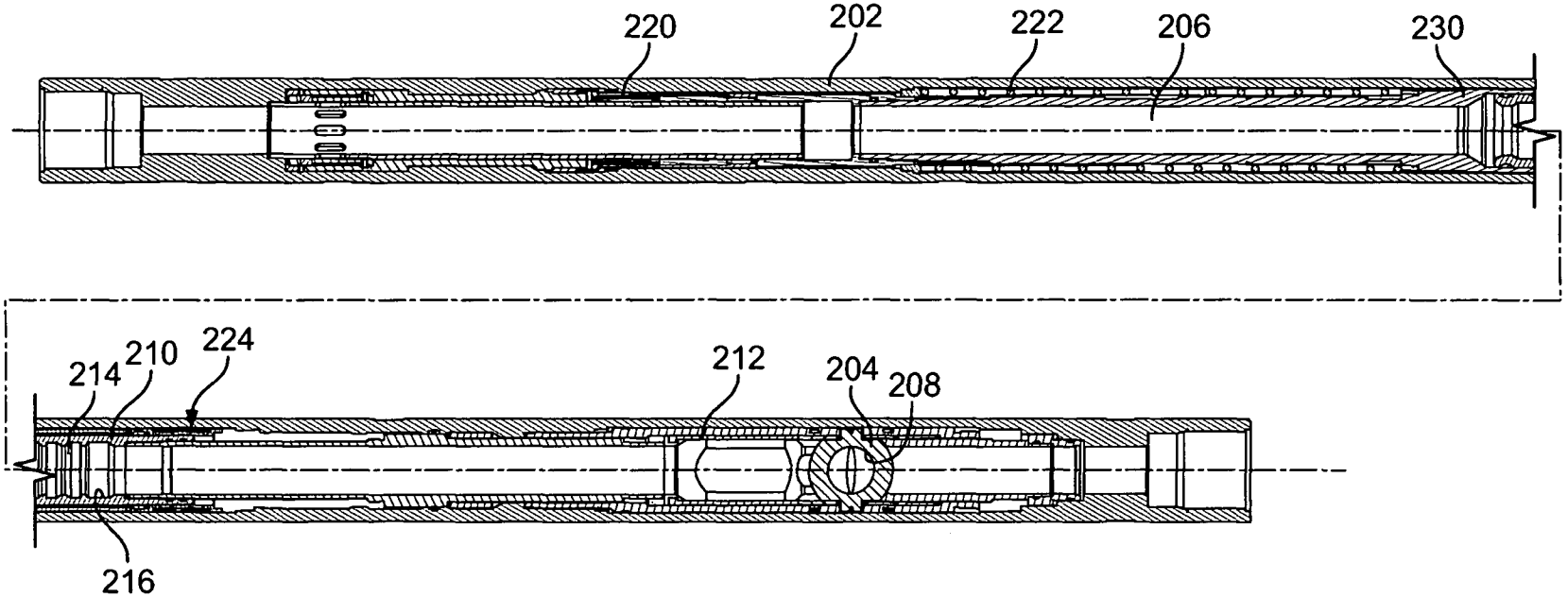

Turning now to FIGS. 2A and 2B, an example valve 200 is depicted in half side cross-section. The example valve 200 can be used as valve 102. The valve 200 includes an elongate, tubular valve housing 202 that extends the length of the valve 200. The housing 202 is shown as made up of multiple parts for convenience of construction, and in other instances, could be made of fewer or more parts. The ends of the housing 202 are configured to couple to other components of the completion string (e.g., threadingly and/or otherwise). The components of the valve 200 define an internal, cylindrical central bore 206 that extends the length of the valve 200. The central bore 206 is typically the largest bore through the valve 200 and, in certain instances, corresponds generally in size to the central bore of the remainder of the completion string. The housing 202 contains spherical ball-type valve closure 204 that, likewise, has a cylindrical, central bore 208 that is part of and that, in certain instances, is the same size as the remainder of the central bore 206. In other instances, the central bore 206 and/or the central bore 208 may be larger or smaller than the central bore of the remainder of the completion string. The valve closure 204 is carried to rotate about an axis transverse to the longitudinal axis of the valve housing 202. The valve 200 is open when the central bore 208 of the valve closure 204 aligns with and coincides with the central bore 206 of the remainder of the valve 200 (FIG. 2A). The valve 200 is closed when the central bore 208 of the valve closure 204 dots not coincide with, and seals against passage of fluid and pressure through, the central bore 206 of the remainder of the valve 200 (FIG. 2B). In other instances, the valve closure 204 can be another type of valve closure, such as a flapper and/or other type of closure.

The valve closure 204 is coupled to an elongate, tubular actuator sleeve 210 via a valve fork 212. The actuator sleeve 210 is carried in the housing 202 to translate between an uphole position (to the left in FIG. 2B) and a downhole position (to the right in FIG. 2A), and correspondingly move the valve fork 212 between an uphole position and a downhole position. When the actuator sleeve 210 (and valve fork 212) are in the uphole position, the valve closure 204 is in the closed position. As the actuator sleeve 210 (and valve fork 212) translates to the downhole position, the valve closure 204 rotates around the transverse axis to the open position.

The valve 200 has provisions for remote operation to operate the valve closure 204 in response to remote signal (e.g., a hydraulic, electric, and/or other signal). To this end, the valve 200 has a remote actuator assembly 220 that is coupled to the actuator sleeve 210. The actuator assembly 220 is responsive to the remote signal to shift the actuator sleeve 210 axially and change the valve between the closed and open positions. While the actuator assembly 220 can take a number of forms, depending on the desired operation of the valve, in certain instances of the valve 200 configured as a fluid isolation valve, the actuator assembly 220 is responsive to a specified number of pressure cycles (increase and decrease) provided in the central bore 208 to release compressed spring 222 carried in the housing 202 and coupled to the actuator sleeve 210. FIG. 2A shows the actuator assembly 220 in an unactuated state with the spring 222 compressed. FIG. 2B shows the actuator assembly 220 in the actuated state with the spring 222 expanded. As seen in the figure, the released spring 222 expands, applies load to and moves the actuator sleeve 210 axially from the uphole position to the downhole position, and thus changes the valve closure 204 from the closed position to the open position. In some implementations, a mandrel 230 carried to move with an end of the spring 222 outputs the actuation loads and axial movement from the spring 222 (i.e., outputs the force and movement of the actuator assembly 220). The pressure cycles are a remote signal in that they are generated remotely from the valve 200, for example, by repeatedly opening and closing a valve in the completion string at the surface, for example, in the well head. One example of such an actuator assembly can be found on the fluid loss isolation barrier valve sold under the trade name FS by Halliburton Energy Services, Inc.

The valve 102 has provisions for mechanical operation to allow operating the valve closure 204 with a shifting tool inserted through the central bore 206. To this end, the actuator sleeve 210 has a profile 214 on its interior bore 216 that is configured to be engaged by a corresponding profile of the shifting tool. The profile 214 enables the shifting tool to grip the actuator sleeve 210 and move it between the uphole position and the downhole position, thus operating the valve closure 204. In the present example, the uphole position corresponds to the valve closure 204 being in the fully closed position and the downhole position corresponds to the valve closure 204 being the fully open position. The shifting tool can be inserted into the valve 200 on a working string of tubing and other components inserted through the completion string from the surface. One example of such an actuator sleeve and shifting tool are those sold with the fluid loss isolation barrier valve sold under the trade name FS by Halliburton Energy Services, Inc. However, other tools capable of gripping the internal profile and manipulating the actuator sleeve 210 could be used.

To facilitate mechanical operation of the valve 200 when the actuator assembly 220 has been actuated, the actuator sleeve 210 can be coupled to the actuator assembly 220 with a coupling assembly 224 that allows the actuator sleeve 210 to move apart from the actuator assembly 220. In other words, because of the coupling assembly 224, the actuator sleeve 210 can move without moving the mandrel 230. Coupling the actuator sleeve 210 to the remote actuator assembly 220 in this manner reduces the amount of force the shifting tool must apply to move the actuator sleeve 210 and allows the actuator sleeve 210 (and thus the valve closure 204) to operated manually both before and after actuating the actuator assembly 220 remotely. For example, in a configuration having a spring 222, the shifting tool does not have to compress the spring 222.

The valve 200 can thus be installed in the well bore and operated manually, with a shifting tool, to open and close multiple times, and as many times as is needed. Thereafter, the valve 200 can be left in a closed state and remotely operated to an open state via a remote signal. After being opened by the remote signal, the valve 200 can again be operated manually, with a shifting tool, to open and close multiple times, as many times as is needed.

Referring now to FIGS. 3A-3E, an example coupling assembly is shown. The example coupling assembly can be used as coupling assembly 224, and is shown in such context.

Figure 3A:
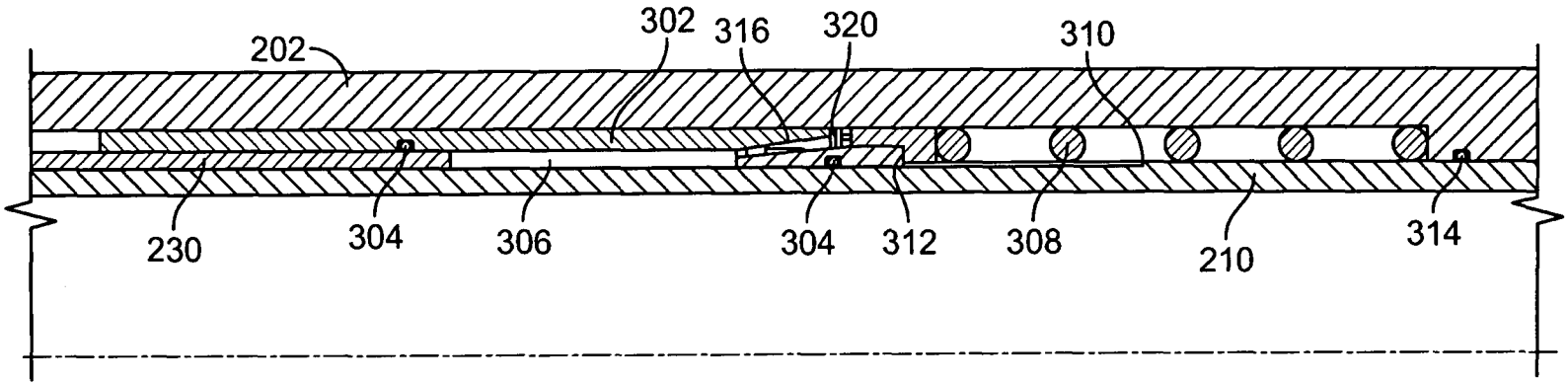
FIGS. 3A-3E are detail quarter cross-sectional views of the example valve of FIGS. 2A and 2B showing the coupling assembly.
Figure 3B:
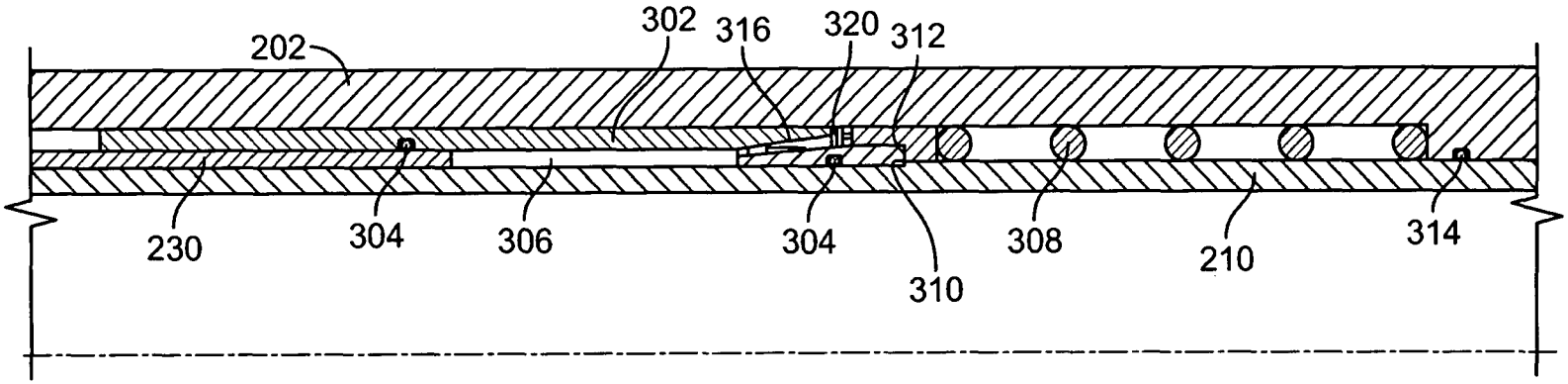

FIG. 3A depicts the valve 200 in a run-in state, with the actuator assembly 220 in an unactuated state (i.e. with the spring 222 compressed and the mandrel 230 in an uphole, unactuated position) and with the actuator sleeve 210 shifted to the right to render the valve closure 204 (FIG. 2A) open. FIG. 3B depicts the valve 200 with the actuator assembly 220 in an unactuated state but with the actuator sleeve 210 shifted to the left to render the valve closure 204 closed.

The lower end of the mandrel 230 is received within an annular piston 302 to define a fluid chamber 306 bounded by and between the actuator sleeve 210 on the chamber's inner diameter, the piston 302 on its outer diameter and at one end the mandrel 230 and the piston 302 at the opposing end. The piston 302 is sealed to the outer diameter of the actuator sleeve 210 and to the outer diameter of the mandrel 230 with seals 304 and 314. The fluid chamber 306 is filled (substantially or entirely) with an incompressible (substantially or entirely) fluid. In certain instances, the fluid is a silicon oil that is substantially incompressible in that it is much more resistant to compression than an aerated incompressible liquid, foam or gas, but nonetheless, can undergo some degree of compression. In certain instances, the piston 302 includes check valve 320 in communication with the fluid chamber 306. The check valve 320 is biased to allow passage of fluid into the fluid chamber 306 and seal against passage of fluid out of the fluid chamber 306, to ensure the fluid chamber 306 is at or above the ambient pressure.

When the actuator assembly 220 is activated in response to a remote signal, it moves the mandrel 230 downhole and the fluid in the fluid chamber 306 communicates this movement to the actuator sleeve 210, via the piston 302. Particularly, the mandrel 230 applies a compressive force to the fluid. The fluid is hydraulically locked in the chamber 306, and thus transmits this force to the piston 302. The fluid force on the piston 302 moves the piston 302 downhole to its actuated position.

With the actuator assembly 220 in the unactuated state and the actuator sleeve 210 shifted to the left to render the valve closure 204 closed, a downhole end 312 of the piston 302 is adjacent, and in certain instances abutting, an uphole facing push shoulder 310 on the outer diameter of the actuator sleeve 210. Thus, when the piston 302 is shifted downhole from its unactuated position to its actuated position, it engages the shoulder 310 and drives the actuator sleeve 210 to the right, opening the valve closure 204. However, with the actuator assembly 220 in the unactuated state, the actuator sleeve 210 can be manually shifted to the right, for example with a shifting tool, to open the valve closure 204. Thus, prior to actuating the actuator assembly 220 in response to a remote signal, the actuator sleeve 210 can be shifted left and right to close and open the valve closure 204 once or multiple times as needed.

Figure 3C:
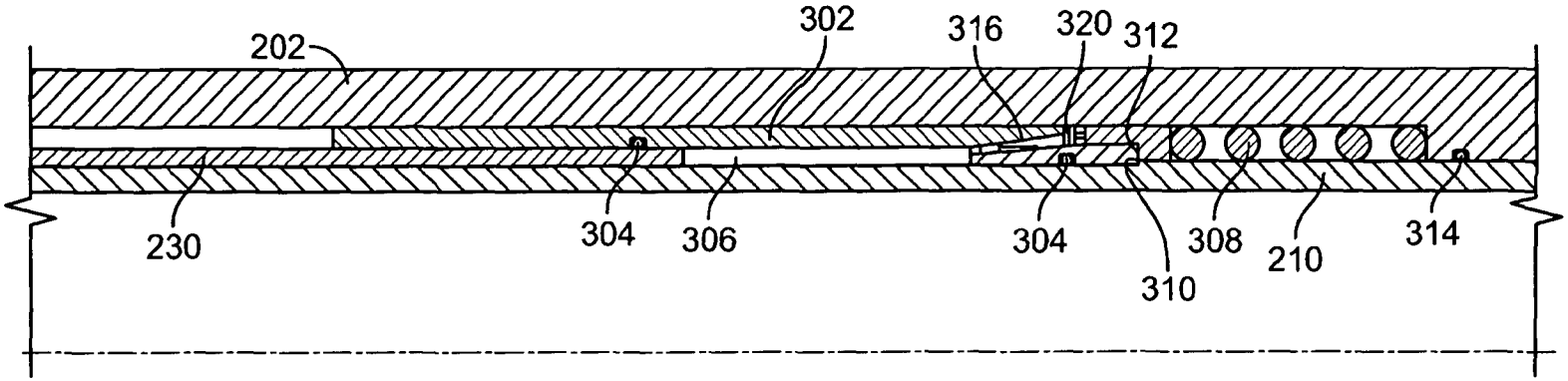
Figure 3D:
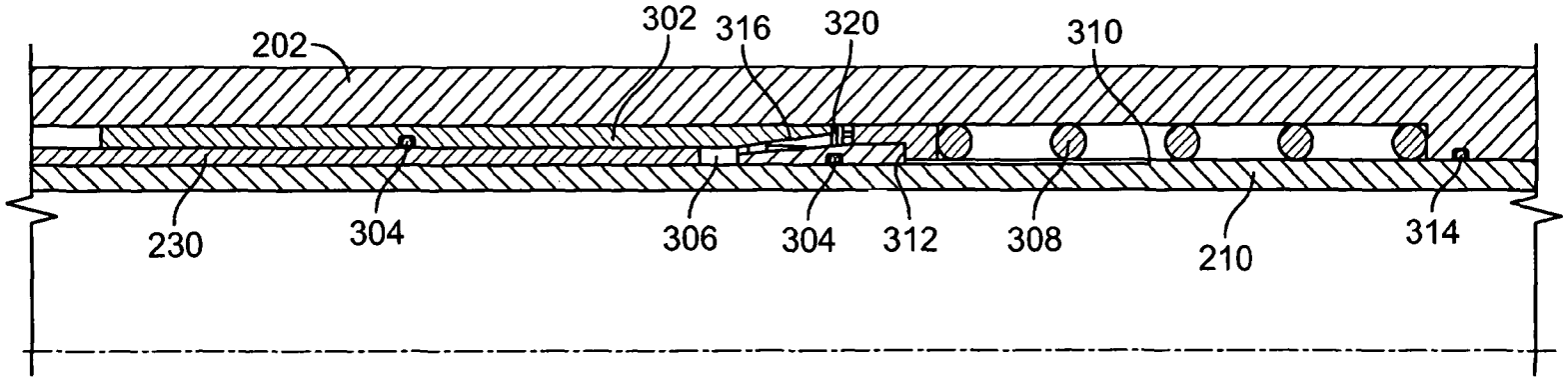
Figure 3E:
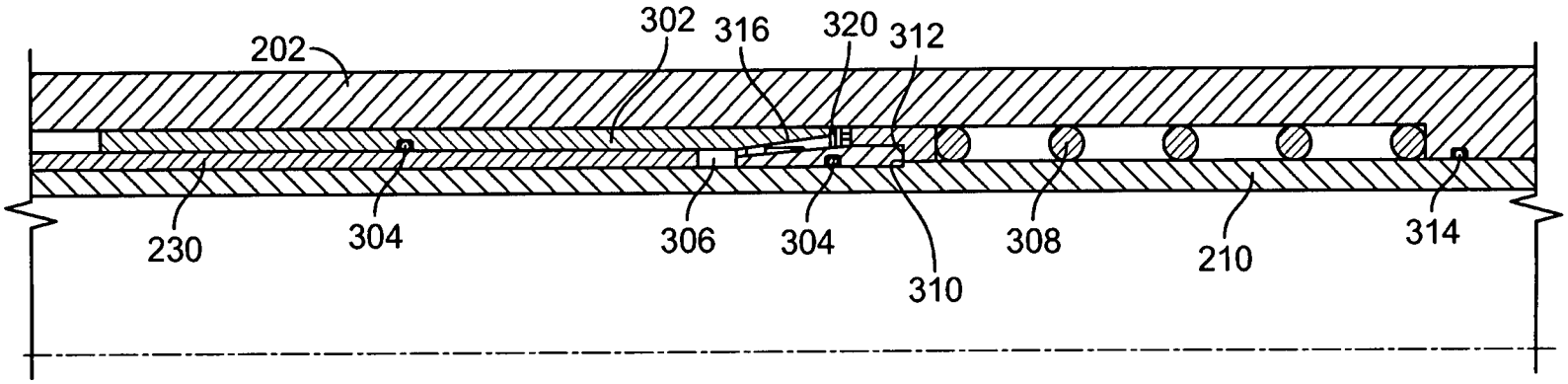

FIG. 3C depicts the valve 200 with the actuator assembly 220 in an actuated state (i.e. with the spring 222 expanded and the mandrel 230 in an downhole, actuated position) and with the actuator sleeve 210 shifted to the right to render the valve closure 204 (FIG. 2B) opened. The piston 302 abuts the shoulder 310 and, at least initially, prevents the actuator sleeve 210 from shifting to the left to close the valve closure 204. However, a spring 308 is provided that acts on and biases the piston 302 uphole, into and tending to compress the fluid cavity 306. This spring 308 puts the fluid in the fluid cavity 306 under pressure. The piston 302 includes a port 316 with an orifice of a specified flow characteristic, particularly a specified restriction. The port 316 defines a leak path that allows the fluid under pressure to leak from the fluid cavity 306 until equalized with the ambient pressure. The orifice fluid characteristic is selected to provide a specified leakage that prevents the fluid from substantially leaking out when subjected to the rapid, high force applied by the mandrel 230 when the spring 222 expands, but allow the fluid to leak out over time when continually subjected to the force applied by the spring 308. FIG. 3D depicts the valve 200 with the actuator assembly 220 in an actuated state but with the piston 302 shifted to the left (away from the shoulder 310) by the spring 308. The fluid in the fluid cavity 306 has leaked out and the fluid cavity 306 has contracted. Because the piston 302 is away from the shoulder 310, the actuator sleeve 210 can be shifted to the left to close the valve closure 204. FIG. 3E depicts the valve 200 with the actuator assembly 220 in an actuated state, the piston shifted to the left by spring 308, and the actuator sleeve 210 shifted to the left to close the valve closure.

Notably, the coupling assembly described above uses few moving parts, instead relying on the concept of hydraulic lock to couple the actuator assembly 220 to the actuator sleeve 210, and thus valve closure 204 or other actuated element. In certain instances, a coupling assembly that operates based on hydraulic lock can be much stronger in a compact space than, for example, a coupling relying on a spring snap ring or frangible connection (e.g., shear pin). The fluid of the hydraulic lock tends to damp impact loading on the coupling experienced when the spring 222 is initially released, and thus reduces the loads the coupling need accommodate. In certain instances, the configuration of the coupling assembly allows the actuator sleeve 210 to be manually manipulated, for example with a shifting tool, once or multiple times as needed both before and after remote actuation of the actuator assembly 220.

A number of examples have been described. Nevertheless, it will be understood that various modifications may be made. Accordingly, other examples are within the scope of the following claims.

What is claimed is:

1. A well tool, comprising:

an actuator sleeve in a housing, the actuator sleeve having an internal shifting tool engaging profile and coupled to an actuated element;

an actuator in the housing, the actuator responsive to a remote signal to change from an unactuated state to an actuated state and shift the actuator sleeve;

a fluid chamber in the housing defined between the actuator sleeve and the actuator, the fluid chamber containing a fluid to communicate movement of the actuator to the actuator sleeve; and a coupling assembly that couples the actuator to the actuator sleeve, and is configured to permit movement of the actuator sleeve independent of the actuator, such that the actuator sleeve is movable by a shifting tool independent of the state of the actuator.

2. The well tool of claim 1, where with the actuator in the unactuated state the actuator sleeve can be moved with a shifting tool between an unactuated position and an actuated position more than one time.

3. The well tool of claim 1, where with the actuator in the actuated state, the actuator sleeve can be moved with a shifting tool between an unactuated position and an actuated position more than one time.

4. The well tool of claim 1, where:

the actuator comprises a mandrel carried in the housing to translate between a first position when the actuator is in an unactuated state and a second position when the actuator is in the actuated state, the mandrel defining a portion of the fluid chamber; and the well tool comprises a piston adapted to engage the actuator sleeve, the piston defining a portion of the fluid chamber, and where movement of the mandrel from the first position to the second position applies compressive force to the fluid, that in turn, moves the piston.

5. The well tool of claim 4, where the actuator comprises:

a spring in the housing, the spring compressed when the actuator is in an unactuated state and expanded when the actuator is in actuated state; and where the mandrel is coupled to move with an end of the spring.

6. The well tool of claim 4, where the actuated element comprises a valve closure in a center bore of the well tool, the valve closure coupled to the actuator sleeve to open and close with movement of the actuator sleeve between an open position and a closed position.

7. The well tool of claim 6, where with the actuator in the unactuated state and the actuator sleeve in the open position, the piston is adjacent to a shoulder of the actuator sleeve and the actuator sleeve can be moved to the closed position; and where the piston engages the shoulder and drives the actuator sleeve to the closed position when the actuator is actuated to the actuated state.

8. The well tool of claim 7 comprising a spring biasing the piston into the fluid chamber, and a leak path from the fluid chamber;

where, with the actuator in the actuated state, the spring acts on the piston, pressurizing the fluid in the fluid chamber to leak out via the leak path.

9. The well tool of claim 8, where as the fluid leaks from the fluid chamber, the spring moves the piston away from the shoulder of the actuator sleeve freeing the actuator sleeve to move to an unactuated position.

10. The well tool of claim 8, where the leak path comprises a fluid passage with an orifice of a specified leakage rate.

11. The well tool of claim 1, comprising a check valve in communication with the fluid chamber and biased to allow passage of fluid into the fluid chamber and seal against passage of fluid out of the fluid chamber.

12. A method of actuating a well tool, comprising:

in response to a remote originating signal, changing an actuator from an unactuated state to an actuated state;

communicating movement of the actuator to an actuator sleeve coupled to an actuated element via a fluid in a chamber, the actuator sleeve having an internal shifting tool engaging profile; and moving the actuator sleeve via a shifting tool, the actuator sleeve coupled to the actuator by a coupling assembly configured to permit movement of the actuator sleeve independent of state of the actuator.

13. The method of claim 12, comprising operating the well tool with the shifting tool prior to changing the actuator from the unactuated state to the actuated state.

14. The method of claim 13, comprising operating the well tool with the shifting tool after changing the actuator from the unactuated state to the actuated state.

15. The method of claim 14, comprising operating the well tool multiple times with the shifting tool both before and after changing the actuator from the unactuated state to the actuated state.

16. The method of claim 12, where the actuated element is a valve closure in a center bore of the well tool and communicating movement of the actuator to the actuator sleeve comprises moving the actuator sleeve to operate the valve closure.

17. A system, comprising:

a remote signal responsive actuator in a well tool housing;

an actuator sleeve in the housing to operate an actuated element of the well tool, the actuator coupled to move with the actuator to an actuated position using a fluid hydraulically locked in a cavity; and a coupling assembly that couples the actuator to the actuator sleeve, and is configured to permit movement of the actuator sleeve independent of the actuator, such that the actuator sleeve is movable by a shifting tool independent of the state of the actuator.

18. The system of claim 17, where the actuated element comprises a valve closure in a center bore of the valve tool, the valve closure coupled to the actuator sleeve to be operated by the actuator sleeve.

19. The system of claim 17, where the actuator sleeve configured to be manually manipulated with a shifting tool both with the actuator in an unactuated position and the actuated position.

20. The system of claim 19, where the fluid in the cavity leaks from the cavity after the actuator is in the actuated position to release the actuator sleeve to be manually manipulated with a shifting tool.

* * * * *